US007062931B2

(12) United States Patent
Wilson

(10) Patent No.: US 7,062,931 B2
(45) Date of Patent: Jun. 20, 2006

(54) REFRIGERATED MERCHANDISER

(75) Inventor: Woodrow Wilson, Charlottetown (CA)

(73) Assignee: Food Trust of Prince Edward Island Limited, Charlottetown (CA)

( * ) Notice: Subject to any disclaimer, the term of this patent is extended or adjusted under 35 U.S.C. 154(b) by 0 days.

(21) Appl. No.: 10/816,803

(22) Filed: Apr. 2, 2004

(65) Prior Publication Data

US 2005/0217297 A1 Oct. 6, 2005

(30) Foreign Application Priority Data

Apr. 1, 2004 (CA) ..... 2462992

(51) Int. Cl.
*A47F 3/04* (2006.01)

(52) U.S. Cl. ..... 62/255; 312/119; 312/122

(58) Field of Classification Search ..... 62/251, 62/255, 256; 312/119, 122
See application file for complete search history.

(56) References Cited

U.S. PATENT DOCUMENTS

| | | | | |
|---|---|---|---|---|
| 2,320,556 | A * | 6/1943 | Belshaw | 312/224 |
| 2,499,089 | A * | 2/1950 | Brill et al. | 62/251 |
| 2,984,085 | A * | 5/1961 | Rainwater | 62/256 |
| 3,369,375 | A * | 2/1968 | Gerweck et al. | 62/256 |
| 4,161,868 | A | 7/1979 | Kennedy et al. | |
| 4,680,942 | A * | 7/1987 | Kooy | 62/256 |
| 5,505,009 | A | 4/1996 | Stein et al. | |
| D385,433 | S | 10/1997 | Baluk et al. | |
| 5,860,289 | A * | 1/1999 | Wetzel | 62/255 |
| 5,964,512 | A * | 10/1999 | Borgen | 312/116 |
| 6,145,327 | A * | 11/2000 | Navarro | 62/89 |
| 6,298,672 | B1 | 10/2001 | Valicoff, Jr. | |
| 6,401,399 | B1 | 6/2002 | Roche et al. | |
| 6,519,962 | B1 | 2/2003 | Schuetter | |
| 6,564,569 | B1 * | 5/2003 | Havens | 62/258 |
| 6,701,736 | B1 | 3/2004 | Johnson | |
| 6,866,352 | B1 * | 3/2005 | Fujii et al. | 312/122 |
| 2003/0172670 | A1 * | 9/2003 | Vormedal | 62/407 |
| 2003/0173876 | A1 | 9/2003 | Fujii et al. | |

FOREIGN PATENT DOCUMENTS

| | | |
|---|---|---|
| CA | 17124 | 9/1949 |
| CA | 51418 | 5/1983 |

* cited by examiner

*Primary Examiner*—William E Tapolcai
(74) *Attorney, Agent, or Firm*—Kirschstein, et al.

(57) ABSTRACT

A refrigerated merchandiser is based on a frame that defines a refrigeration chamber that houses a unit cooler, which is in communication with a cooled air plenum that, in turn, is in communication with a display chamber. The unit cooler supplies cooled air to the plenum. The cooled air that is supplied to the plenum is then provided to a shelf that is mounted in the display chamber. Additionally, the cooled air is provided to at least one drawer, which is slidably mounted in the display chamber.

21 Claims, 7 Drawing Sheets

REFRIGERATED MERCHANDISER

FIELD OF THE INVENTION

The present invention relates to an apparatus for cooling and displaying produce.

BACKGROUND

It is known that the use of cool temperatures for storing produce assists in maintaining freshness of the produce. With respect to potatoes, for example, it is known that potatoes maintained below 10° Celsius are in a dormant state (i.e., a state in which the potatoes do not sprout eyes). However, potatoes and other produce are presently often displayed on angled tables in open areas of produce sections in grocery stores. While such angled tables may present produce displays that are pleasing to the eye and facilitate consumers selecting produce for purchase, the angled tables do not typically provide refrigeration and do not facilitate efficient refrigeration methods.

SUMMARY

A refrigerated merchandiser for displaying produce has one or more drawers and one or more shelves. The produce in the drawers and on the shelves is cooled by a refrigeration unit that supplies cooled air to a plenum. Passageways in communication with the plenum supply the cooled air to the drawers and shelves, thereby assisting in the maintenance of freshness of the produce. Much of the air that has cooled the produce is then returned to the refrigeration unit for cooling and recirculation. Optionally, the produce, which may be a variety of types of produce, may be arranged by type where each type is associated with a manner of preparation.

In accordance with an aspect of the present invention there is provided a merchandiser for cooling and displaying produce. The merchandiser includes a frame defining a cooled air plenum, a unit cooler for supplying cooled air to the plenum, a shelf mounted to the frame below a first cooled air egress passageway in communication with the plenum and a drawer slidably mounted in the frame below a second cooled air egress passageway in communication with the plenum. The cooled air that spills out of one of the shelf and the drawer is received by the other of the shelf and the drawer and the cooled air that spills out of the other of the shelf and the drawer is received by the unit cooler for further cooling.

In accordance with another aspect of the present invention there is provided a method of displaying a plurality of types of produce. The method includes arranging the plurality of types of produce by manner of preparation and associating each type of the plurality of types of produce with an indication of the manner of preparation.

Other aspects and features of the present invention will become apparent to those of ordinary skill in the art upon review of the following description of specific embodiments of the invention in conjunction with the accompanying figures.

DETAILED DESCRIPTION

Figure 1:
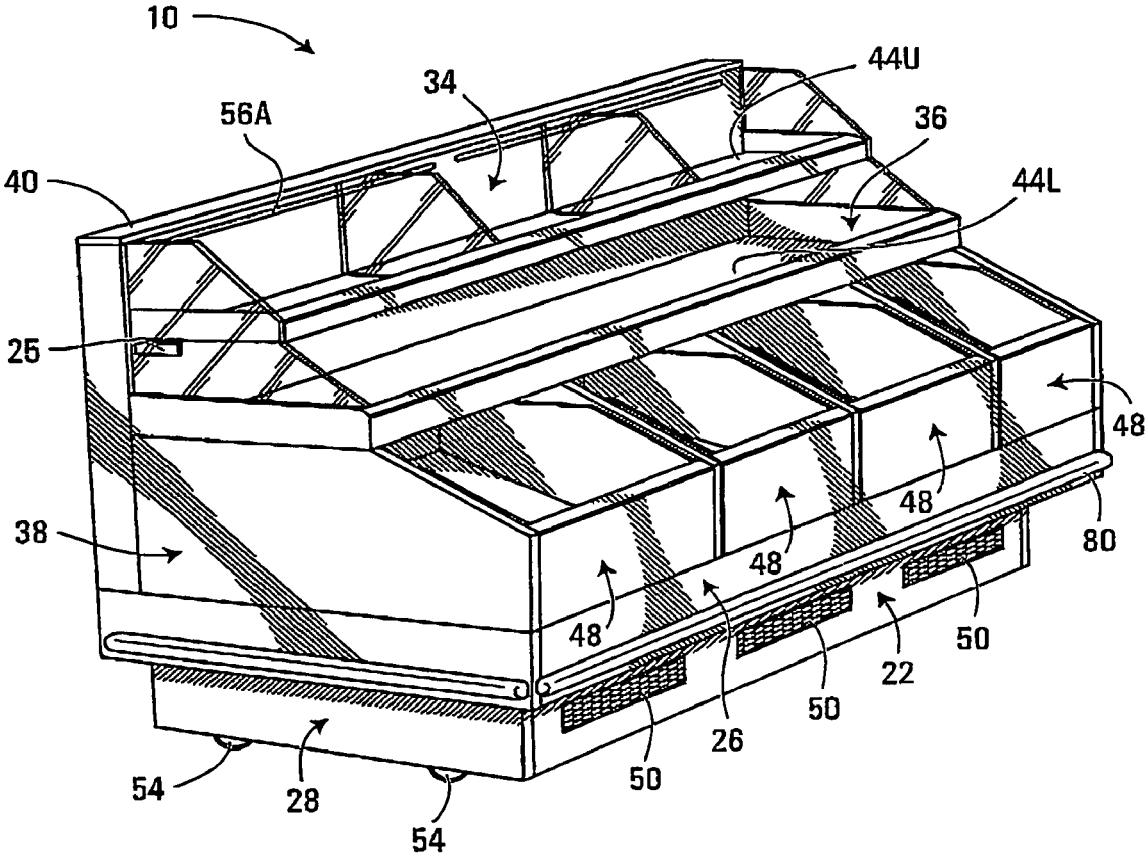
FIG. 1 is a front left perspective view of a refrigerated merchandiser according to an embodiment of the present invention.
Figure 2:
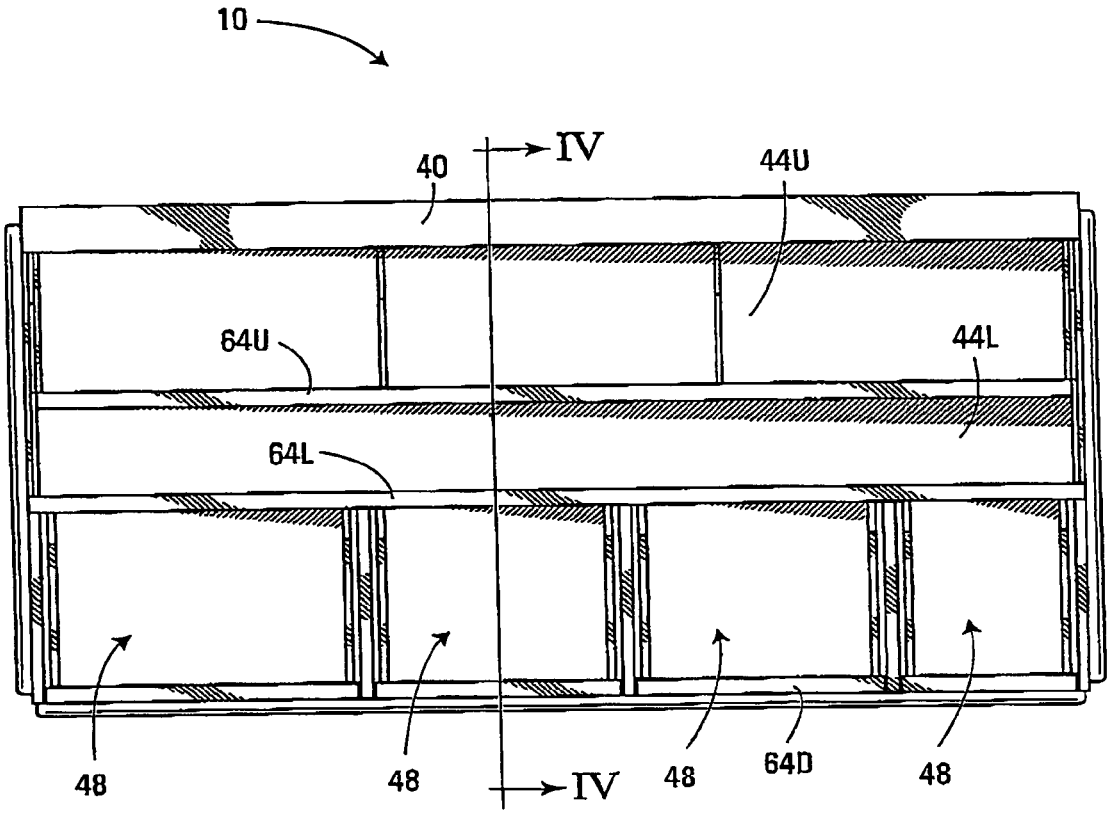
FIG. 2 is a front elevation view of the refrigerated merchandiser of FIG. 1.
Figure 3:
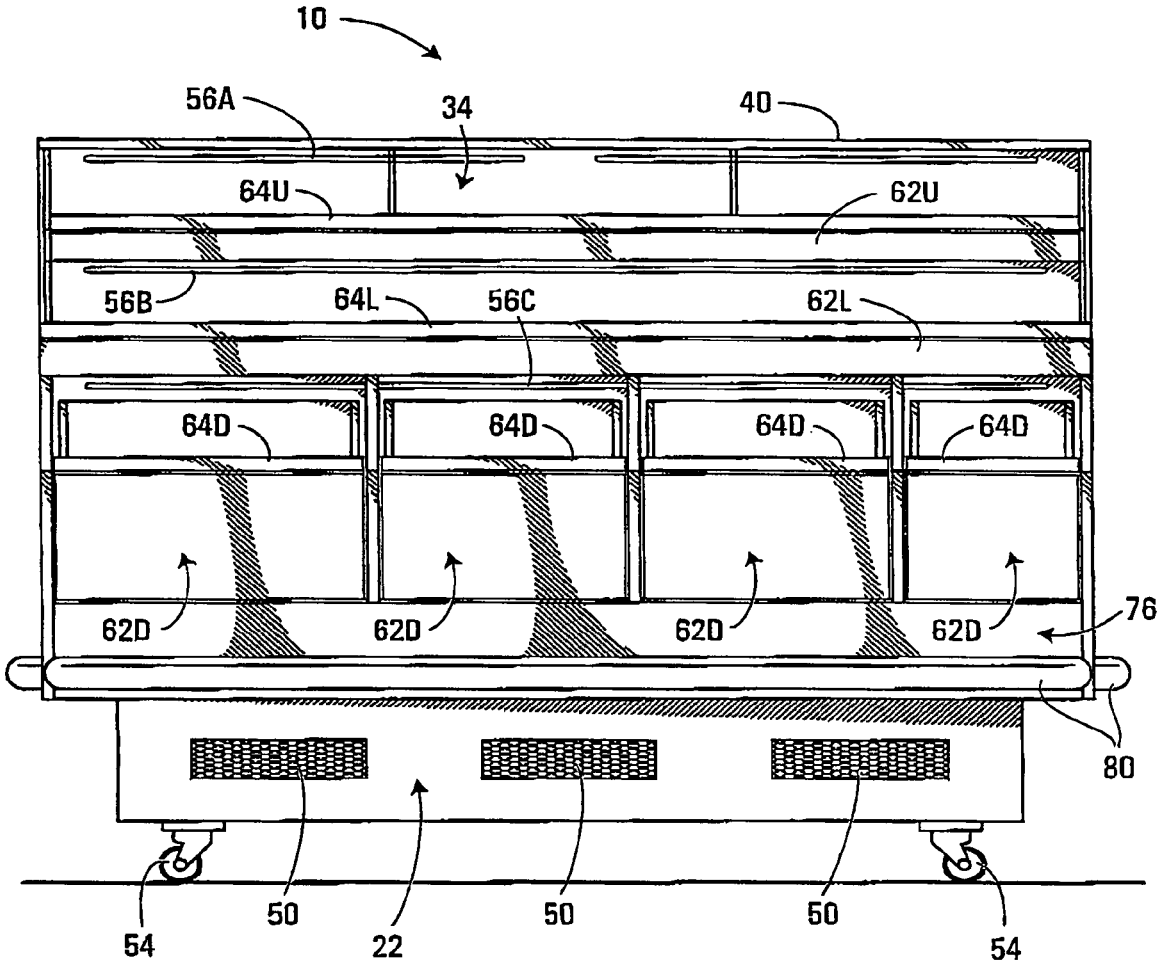
FIG. 3 is a plan view of the refrigerated merchandiser of FIG. 1.

FIG. 1 illustrates an exemplary refrigerated merchandiser 10 showing one embodiment of the present invention. The refrigerated merchandiser 10 has a frame that defines a display chamber 16. The display chamber 16 has an open top and front and is defined by an upper plenum front wall 34, an upper right side wall 36, an upper left side wall 38 and a display chamber floor 42.

In the embodiment shown in FIG. 1, the display chamber 16 houses two shelves, namely an upper shelf 44U and a lower shelf 44L (collectively or individually 44), and four drawers 48, although it should be clear that the number of shelves 44 and drawers 48 is merely a design consideration.

Figure 4:
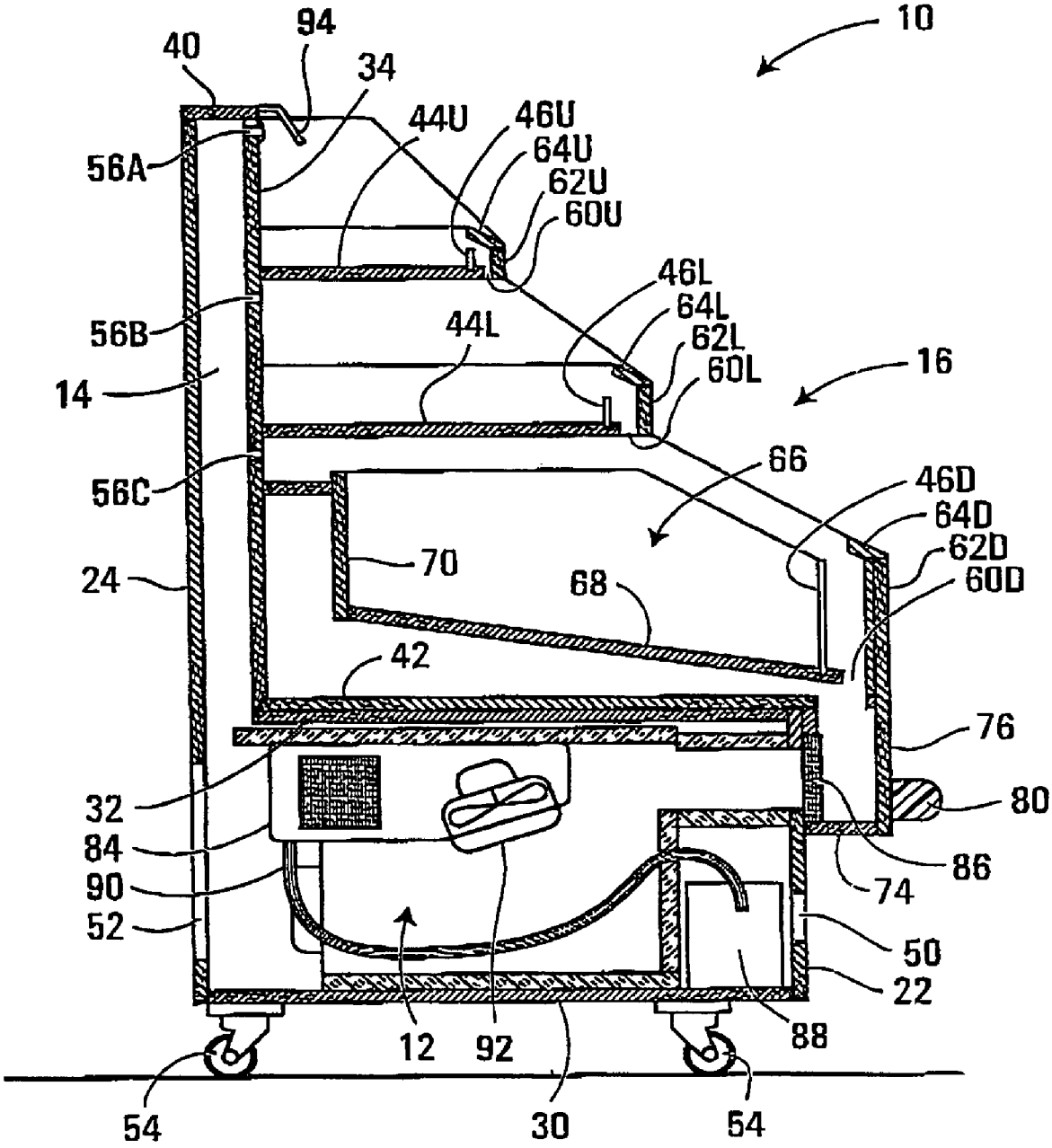
FIG. 4 is a sectional view of the refrigerated merchandiser of FIG. 1.

The frame of the refrigerated merchandiser 10 also defines a refrigeration chamber and an upper plenum 14, which may be considered in view of FIG. 4. In particular, the refrigeration chamber is defined by a lower front wall 22, a back wall 24, a lower right side wall 26, a lower left side wall 28, a refrigeration chamber floor 30 and a refrigeration chamber ceiling 32. As well, the upper plenum 14 is defined by the back wall 24, the upper plenum front wall 34, the upper right side wall 36, the upper left side wall 38, the refrigeration chamber ceiling 32 and an upper plenum ceiling 40.

A lower plenum 12 is mounted within the refrigeration chamber (see FIG. 4) as a sheet metal enclosure surrounded by, e.g., one inch of insulation. Mounted within the lower plenum 12 and communicating air, via a passageway in the refrigeration chamber ceiling 32, from the lower plenum 12 to the upper plenum 14 is a unit cooler 84, which includes a fan 92. The unit cooler 84 may, in practice, include a series of radiators and fans. As will be familiar, the radiators are adapted to pass cooled matter from an ingress to an egress and the fan 92 promotes flow of return air past the radiators and toward the upper plenum 14. The unit cooler 84 may be, as illustrated in FIG. 4, fixed to the refrigeration chamber ceiling 32 toward the back wall 24. From the bottom of the unit cooler, a condensate line 90 communicates with a drip pan 88.

As illustrated in the embodiment of FIG. 1, three front vents 50 are illustrated on the lower front wall 22. Further, as illustrated in FIG. 4, at least one solid, yet removable, back access panel 52 may be provided in the back wall 24. Additionally, movement of the exemplary refrigerated merchandiser 10 is facilitated by attachment of four caster wheels 54 to the bottom of the refrigeration chamber floor 30.

Proximate to the top of the refrigeration chamber and extending from the lower front wall 22 may be an extension that forms a refrigeration chamber return air channel 72. The refrigeration chamber return air channel 72 may be defined by a channel floor 74, a channel front wall 76 and a channel top wall 78. Between the refrigeration chamber return air channel 72 and the lower plenum 12 may be an air filter 86.

As the refrigerated merchandiser 10 may be used in grocery store applications, a bumper strip 80 is provided on the channel front wall 76. The height for the bumper strip 80 should be set to correspond with the height at which a grocery cart would contact the refrigerated merchandiser 10. Notably, extensions to the lower right side wall 26 and the lower left side wall 28 are only needed to support the bumper strip 80 and do not necessarily form a channel within the refrigeration chamber.

At each end of the upper shelf 44U is an upper gable and the upper shelf 44U is divided into three sections through the use of two dividing gables. The upper shelf 44U includes an upper air movement deflector 46U extending vertically upwards along the width of the upper shelf 44U from a position proximal to the front of the upper shelf 44U. An upper shelf front wall 62U is mounted between the upper right side wall 36 and the upper left side wall 38 in front of the upper shelf 44U such that the upper air movement deflector 46U and the upper shelf front wall 62U define an upper return air channel 60U.

Similarly, at each end of the lower shelf 44L is a lower gable. Additionally, the lower shelf 44L includes a lower air movement deflector 46L extending vertically upwards along the width of the lower shelf 44L from a position proximal to the front of the lower shelf 44L. A lower shelf front wall 62L is mounted between the upper right side wall 36 and the upper left side wall 38 in front of the lower shelf 44L such that the lower air movement deflector 46L and the lower shelf front wall 62L define a lower return air channel 60L.

Each drawer 48 includes two drawer side walls 66 (only one of which is illustrated in FIG. 4) a drawer back wall 70, a drawer floor 68 and drawer front wall 62D. The drawer floor 68 is angled slightly toward the drawer front wall 62D such that, when only a few items remain in the drawer 48, the items tend, under force of gravity, to gather at the front of the drawer 48. Additionally, the drawer floor 68 extends from the drawer back wall 70 to a forward extent that is just short of the drawer front wall 62D. A drawer air movement deflector 46D extends vertically upwards along the width of the drawer 48 between the drawer side walls 66 from a position proximal to the forward extent of the drawer floor 68. The drawer air movement deflector 46D, the drawer front wall 62D and the forward extent of the drawer floor 68 define a drawer return air channel 60D.

As illustrated in the embodiment of FIG. 4, each of the upper shelf front wall 62U, the lower shelf front wall 62L and the drawer front wall 62D may be provided with a corresponding ticket wall, namely an upper ticket wall 64U, a lower ticket wall 64L and a drawer ticket wall 64D (collectively or individually 64).

The channel front wall 76 may be arranged to be flush with the drawer front wall 62D such that the bumper strip is contacted, by, say, a grocery cart, before any other portion of the refrigerated merchandiser 10.

To communicate cooled air from the upper plenum 14 to the display chamber 16, three passageways 56A, 56B, 56C (collectively or individually 56) are provided in the plenum front wall 34.

In overview, the refrigerated merchandiser 10 is based on a frame that defines a refrigeration chamber in which is mounted the lower plenum 12 housing the unit cooler 84, which is in communication with the upper plenum 14 that, in turn, is in communication with the display chamber 16. The unit cooler 84 cools relatively warmer air contained within the lower plenum 12 and supplies the cooled air to the upper plenum 14. The cooled air that is supplied to the upper plenum 14 is provided to the upper shelf 44U and lower shelf 44L, which are mounted in the display chamber 16. Additionally, the cooled air is provided to at least one drawer 48, which is slidably mounted in the display chamber 16.

In operation, the unit cooler 84 mounted in communication with the lower plenum 12 supplies cooled air to the upper plenum 14. A first passageway 56A in the plenum front wall 34 provides a curtain of cooled air to the upper shelf 44U, a second passageway 56B in the plenum front wall 34 provides a curtain of cooled air to the lower shelf 44L and a third passageway 56C in the plenum front wall 34 provides a curtain of cooled air to the drawers 48.

Figure 5:
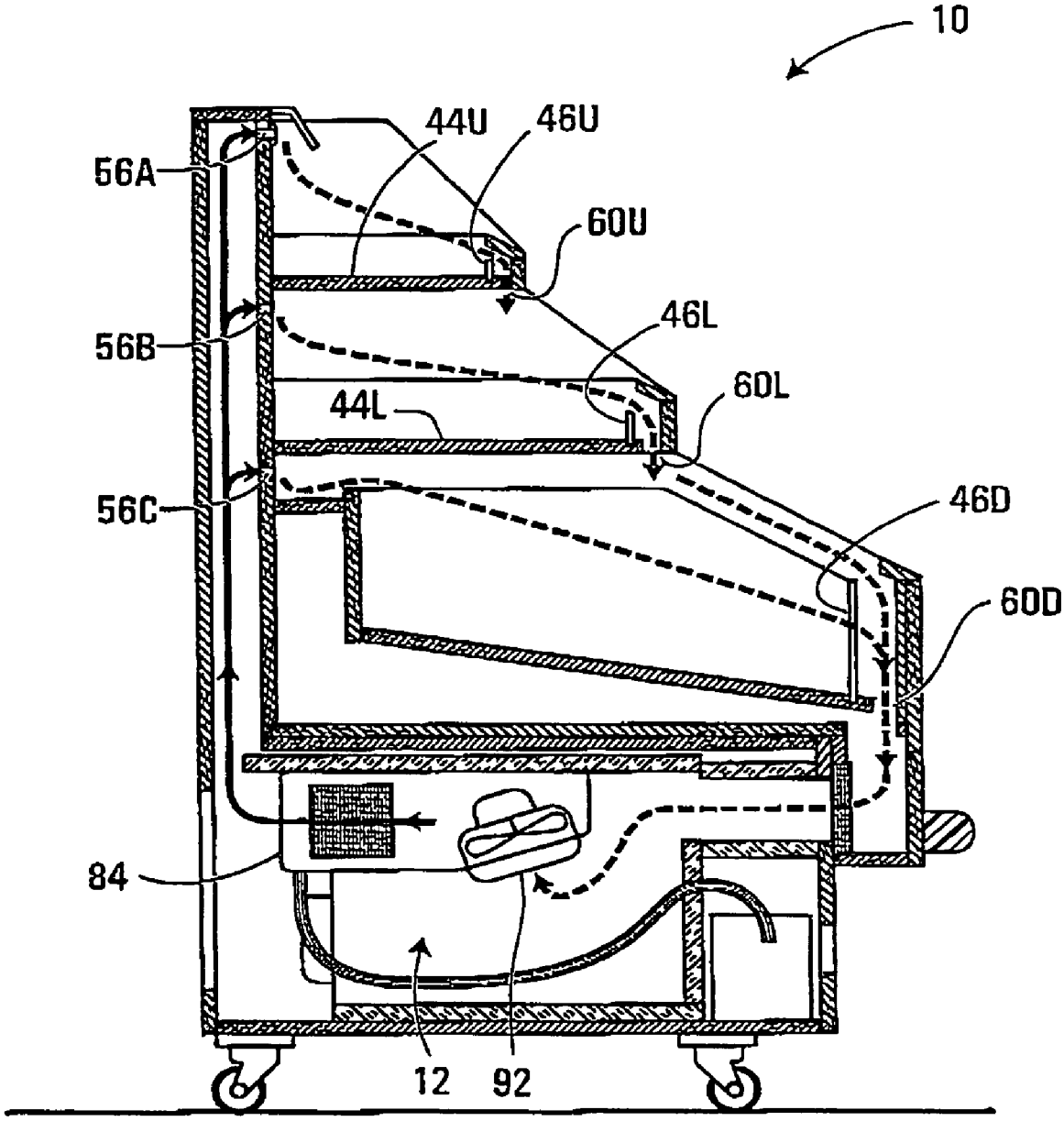
FIG. 5 is a sectional view of the refrigerated merchandiser showing air flow.

Additionally, as illustrated in the airflow diagram of FIG. 5, some of the cooled air that is provided to the upper shelf 44U by the first passageway 56A may be maintained on the upper shelf 44U by the upper air movement deflector 46U. Any excess cooled air is allowed to spill over the upper air movement deflector 46U and through the upper return air channel 60U down to the lower shelf 44L.

Similarly, some of the cooled air that is provided to the lower shelf 44L by the second passageway 56B may be maintained on the lower shelf 44L by the lower air movement deflector 46L. Any excess cooled air is allowed to spill over the lower air movement deflector 46L and through the lower return air channel 60L down to the drawers 48.

The cooled air that enters the display chamber 16 by the third passageway 56B is provided to the drawers 48. Rather than spill over a lip-like air movement deflector as the cooled air does on the shelves, the drawer air movement deflector 46D, which is considerably taller than the upper air movement deflector 46U and the lower air movement deflector 46L, is perforated to allow the cooled air to pass through the drawer air movement deflector 46D, into the drawer return air channel 60D and into the refrigeration chamber return air channel 72.

The return air received in the refrigeration chamber return air channel 72 is drawn through the air filter 86 into the lower plenum 12 by the fan 92 and subsequently drawn into the unit cooler 84 for further cooling.

In the process of cooling the air from the lower plenum 12, humidity may be removed from the air. The humidity is converted into liquid condensate water as the air in which the humidity is suspended is cooled and the condensate water is allowed to exit the unit cooler 84 by way of the condensate line 90. The condensate water is fed through the condensate line 90 into the drip pan 88.

Also known as an evaporator, the unit cooler 84 removes heat from the air drawn into the unit cooler 84 from the lower plenum 12. This is achieved by a heat exchange system, wherein cooled refrigerant gas from an associated condensing unit (not shown) is pumped through a radiator through which air from the lower plenum 12 is passed by means of fans, including the fan 92. The air cools down and the refrigerant gas heats up. The hot refrigerant gas is sent back to the condensing unit. The hot gas lines (not shown) that carry the hot refrigerant gas to the condensing unit may be channelled through the condensate water in the drip pan 88. By doing so, the evaporation of the condensate water from the unit cooler 84, and through the front vents 50, is assisted, thereby reducing the necessary size for the drip pan 88. Some preliminary cooling of the hot refrigerant gas takes place as the refrigerant gas passes through the hot gas lines in the drip pan, as this is another heat exchange system. This, in turn, improves the efficiency of the unit cooler 84.

The upper ticket wall 64U and the lower ticket wall 64L may be considered to enhance the direction of cooled air spilling off the respective upper shelf 44U and lower shelf 44L and through the respective upper return air channel 60U and lower return air channel 60L. In addition to enhancing the direction of cooled air through the return air channels 60U, 60L, the ticket walls 64 may be used to indicate the contents of the corresponding shelf or drawer as well as providing additional information such as price and manner of preparation (as will be discussed hereinafter). Additionally, the ticket wall 64 may be used to display advertising and promotion material. The angle that the ticket wall 64 forms with the vertical is preferably selected to take into account its dual function. That is, the angle should be selected to appropriately display information to a consumer while, simultaneously, enhancing the direction of cooled air through the return air channels.

As will be understood by a person skilled in the art, a thermostat 25 (FIG. 1) may be provided to control power cycling of the condensing unit and thereby control the temperature at which the produce is maintained. Furthermore, the passageways 56 need not be continuous across the width of the refrigerated merchandiser 10. For example, the first passageway 56A may be formed of three distinct passageways. Each of the distinct passageways may be selectively and gradually opened, say, through the use of flaps or sliding doors, or closed to control the volume of air flowing in to the corresponding section of the upper shelf 44U. Accordingly, one section of the upper shelf 44U may be utilized to display items which do not require cooling, or require cooling to a lesser degree, such as various condiments, which may be associated with the produce on display in the other sections of the upper shelf 44U, on the lower shelf 44L and in the drawers 48. Extending the control of a single section temperature to include thermostatic control, each section of the refrigerated merchandiser 10 may be provided with a controlled volume of air cooled in a specific manner, thereby providing for variation in degree of cooling for various sections of the refrigerated merchandiser 10.

Figure 6:
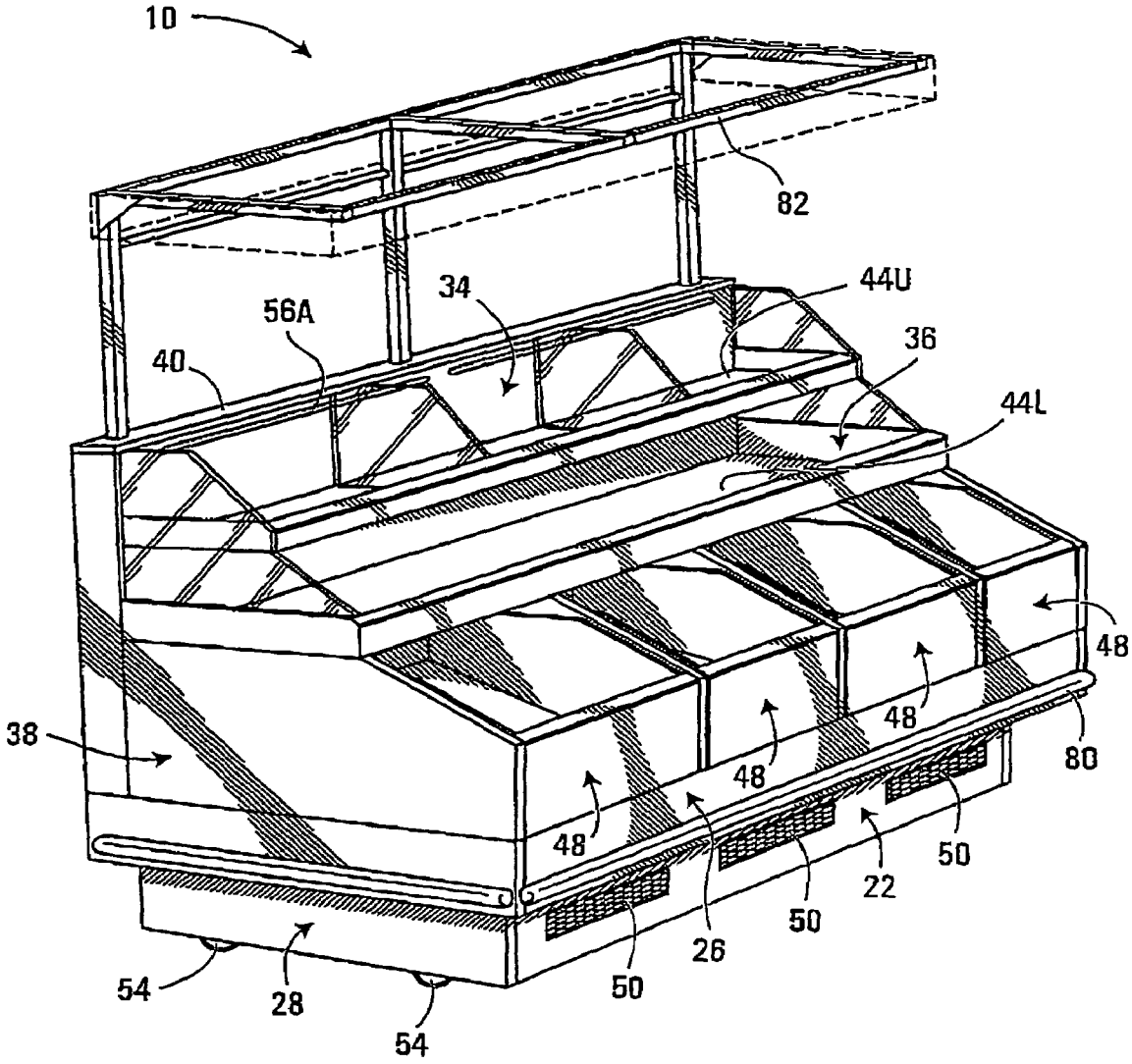
FIG. 6 is a front left perspective view of a refrigerated merchandiser including an awning according to an embodiment of the present invention.

It is known that typical grocery store lighting can cause the formation of bad tasting and potentially toxic glycoalkaloids in potatoes. As such, an awning frame 82, for supporting an awning, may be attached to the refrigerated merchandiser 10 (see FIG. 6) to shade the produce, in this case potatoes, from the grocery store lighting. Furthermore, an alternate light source (not shown), such as a florescent light bulb, may be provided on the under side of the awning, attached to the awning frame 82, to provide light to the produce display that may be perceived as missing due to the shade from the grocery store lighting. As will be understood, the alternate light source should provide light at an intensity and wavelength that will not induce glycoalkaloid formation.

Without regard to the presence or absence of the awning, the placement of the drawers 48 under the lower shelf 44L may be seen to shade a majority (say, 70%) of the produce in the drawers 48, thereby inhibiting glycoalkaloid formation. To a lesser extent, the upper shelf 44U may be seen to shade the lower shelf 44L.

Continuing the example of potatoes, while bearing in mind that the refrigerated merchandiser may be used for a wide range of produce, the standard grocery store fruit and vegetable display table is known to hold 300–400 lbs. of potatoes. The refrigerated merchandiser 10 exemplary of the present invention has been shown to hold as much as 800 lbs. of potatoes.

A standard measure of profitability of grocery store space is measured per linear foot. Comparing the standard grocery store fruit and vegetable display table to the refrigerated merchandiser 10 exemplary of the present invention, it should be clear that a great deal more produce may be displayed per linear foot on the refrigerated merchandiser 10 than on the standard grocery store fruit and vegetable display table. As such, a significant increase in profitability may be realised by the grocery retailer for the space occupied by the refrigerated merchandiser 10.

Combined with the weight of the materials that make up the refrigerated merchandiser 10, a loaded refrigerated merchandiser can weigh as much as 1300 lbs. As such, the caster wheels 54 should be selected to bear such weight. In addition, the materials chosen for the refrigerated merchandiser 10 should also be suitable to the weight of the produce. For the merchandising of potatoes, the applicants have had success with architectural plywood. In addition, as has been discussed hereinbefore, a sliding mechanism is used to mount the drawers to the dividers. Although the applicants have found that a side mounted sliding mechanism is preferable when the drawers 48 are to hold weighty produce such as potatoes, it is recognised that a bottom mounted sliding mechanism may be useful for when the drawers 48 are to hold less weighty produce.

As should be clear to a person skilled in the art of refrigeration, in one embodiment of the present invention, the pressure of the cooled air in the upper plenum 14 is set such that the rates of egress of cooled air through the passageways 56 are equivalent.

Figure 7:
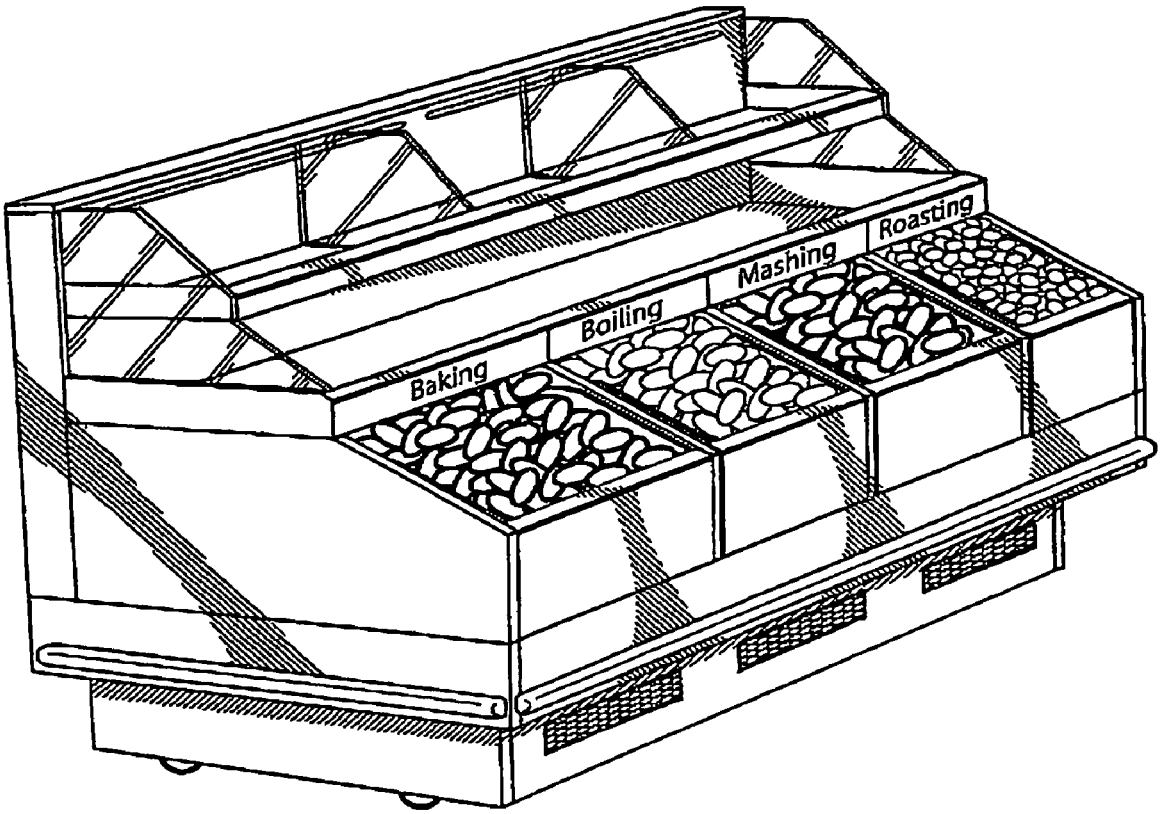
FIG. 7 is a front left perspective view of a refrigerated merchandiser loaded with exemplary produce according to an embodiment of the present invention.

As mentioned briefly hereinbefore, the produce displayed by the refrigerated merchandiser may be arranged by type where each type is associated with a manner of preparation, as illustrated in FIG. 7. Returning to the exemplary produce, potatoes, the four drawers 48 may respectively hold loose potatoes well suited to baking, boiling, mashing and roasting. Above each drawer 48, the lower shelf 44L may contain pre-packaged collections of the same varieties of potatoes that exist loose in the drawer 48 below. The upper shelf 44U may be used to display pre-packaged collections of some varieties of potatoes that receive lower-volume sales, such as potatoes well suited to French frying or petite gourmet boiling. The pre-packaged collections may include, as part of a label, directions for preparation. The upper shelf front wall 62U, the lower shelf front wall 62L and the drawer front wall 62D may be used to identify the manner of preparation for which the potatoes in the corresponding compartment are well suited, thereby leaving the ticket wall 64 available for presentation of pricing information.

The refrigerated merchandiser 10 of the present invention may be shown to provide advantages to consumers in the form of higher quality produce, due to maintenance of the produce at a proper storage temperature. Additionally, the refrigerated merchandiser 10 of the present invention may be shown to provide advantages to retailers in the form of increased profitability for a given size of display area.

Other modifications will be apparent to those skilled in the art and, therefore, the invention is defined in the claims.

I claim:

1. A merchandiser for cooling and displaying produce comprising:

a frame defining a cooled air plenum;

a unit cooler for supplying cooled air to said plenum;

a shelf mounted to said frame below a first cooled air egress passageway in communication with said plenum; and a drawer slidably mounted in said frame below a second cooled air egress passageway in communication with said plenum;

wherein said merchandiser is adapted such that cooled air that spills out of one of said shelf and said drawer is received by the other of said shelf and said drawer; and wherein said merchandiser is adapted such that cooled air that spills out of the other of said shelf and said drawer is received by said unit cooler for further cooling.

2. The merchandiser of claim 1 wherein said frame further defines a refrigerated chamber in which said unit cooler is enclosed and said merchandiser further comprises a right side wall and a left side wall that, in combination with the front of said plenum and the top of said refrigerated chamber, define a display chamber.

3. The merchandiser of claim 2 wherein said shelf includes an air movement deflector extending vertically upwards along the width of said shelf proximate an edge of said shelf that is distal from said plenum.

4. The merchandiser of claim 3 further comprising a shelf front wall mounted between said right side wall and said left side wall in front of said shelf such that said air movement deflector and said shelf front wall define a return air channel.

5. The merchandiser of claim 4 further comprising an angled wall mounted to the top of said shelf front wall such that said angled wall extends upward and toward said plenum.

6. The merchandiser of claim 2 further comprising an awning frame and an awning, supported by said awning frame, to shade said display chamber.

7. The merchandiser of claim 1 wherein said drawer includes a drawer floor and drawer front wall, where said drawer floor is angled slightly downward toward said drawer front wall.

8. The merchandiser of claim 7 wherein said drawer floor extends to a forward extent that is short of said drawer front wall.

9. The merchandiser of claim 1 further comprising castors mounted to the bottom of said frame to facilitate relocation of said merchandiser.

10. The merchandiser of claim 1 wherein said produce is available in a plurality of types and said plurality of types of said produce are arranged by manner of preparation.

11. The merchandiser of claim 10 further comprising an indication of said manner of preparation associated with each type of said plurality of types.

12. The merchandiser of claim 11 wherein said produce is potatoes.

13. The merchandiser of claim 12 wherein said manner of preparation is selected from the group comprising: boiling, baking, mashing, roasting and French frying.

14. The merchandiser of claim 12 wherein said cooled air is maintained below around 10° Celsius.

15. The merchandiser of claim 1 further comprising a drip pan and a condensate line to communicate condensate water from said unit cooler to said drip pan.

16. The merchandiser of claim 15 wherein said drip pan is positioned proximate a vent in a wall of said merchandiser to facilitate evaporation of said condensate water.

17. The merchandiser of claim 1 wherein a size of said first cooled air egress passageway may be adjusted to suit a degree of cooling required for said shelf.

18. The merchandiser of claim 1 wherein said unit cooler comprises:

a radiator adapted to pass cooled matter from an ingress to an egress;

a fan for promoting flow of said cooled air received by said unit cooler for further cooling past said radiator and toward said cooled air plenum.

19. The merchandiser of claim 1 wherein said shelf is mounted to said frame over said drawer such that said shelf shades at least a portion of an interior of said drawer.

20. A merchandiser for cooling and displaying produce comprising:

a frame defining a cooled air plenum;

a unit cooler for supplying cooled air to said plenum;

a shelf mounted to said frame below a first cooled air egress passageway in communication with said plenum; and a drawer slidably mounted in said frame below a second cooled air egress passageway in communication with said plenum, wherein said drawer includes:

a drawer front wall;

a drawer floor angled slightly downward toward said drawer front wall and extending to a forward extent that is short of said drawer front wall; and a perforated wall extending vertically upwards along the width of said drawer;

wherein said merchandiser is adapted such that cooled air that spills out of one of said shelf and said drawer is received by the other of said shelf and said drawer; and wherein said merchandiser is adapted such that cooled air that spills out of the other of said shelf and said drawer is received by said unit cooler for further cooling.

21. The merchandiser of claim 20 wherein said perforated wall, said drawer front wall and said forward extent of said drawer floor define a drawer return air channel.

* * * * *